US005624048A

United States Patent [19]

Sander et al.

[11] Patent Number: 5,624,048

[45] Date of Patent: Apr. 29, 1997

[54] INSULATED CARRYING CONTAINER

[76] Inventors: Ronen Sander, 201 Bnei Efraim Street, POB 53121, Tel Aviv 61531; Leor Seef, Moshav Orot, Kiryat Malachi 83810, both of Israel

[21] Appl. No.: 389,458

[22] Filed: Feb. 16, 1995

[30] Foreign Application Priority Data

Nov. 1, 1994 [IL] Israel ..... 111.492

[51] Int. Cl.[6] ..... B65D 81/38

[52] U.S. Cl. ..... 215/395; 215/13.1; 150/901; 220/903; 229/89; 229/91; 383/10; 383/99; 383/110

[58] Field of Search ..... 215/13.1, 395; 220/903; 150/901; 229/89, 91; 383/110, 10, 99; 206/147

[56] References Cited

U.S. PATENT DOCUMENTS

| | | | |
|---|---|---|---|
| 1,116,932 | 11/1914 | Schwartz et al. | 383/110 |
| 1,228,258 | 5/1917 | Sullivan | 220/903 X |
| 1,939,677 | 12/1933 | Epstein | 46/40 |
| 2,756,922 | 7/1956 | Adams | 383/10 |
| 3,349,990 | 10/1967 | Woodford | 383/110 X |
| 4,059,222 | 11/1977 | Gamble | 383/10 |
| 4,197,890 | 4/1980 | Simko | 150/2.2 |
| 4,282,279 | 8/1981 | Strickland | 229/91 X |
| 4,796,937 | 1/1989 | Andrea | 220/903 X |
| 4,825,089 | 4/1989 | Lindsay | 250/515.1 |
| 4,854,736 | 8/1989 | McVeigh | 383/110 X |
| 4,868,025 | 9/1989 | Strzelewicz | 428/35.2 |
| 4,872,766 | 10/1989 | Dancy | 383/10 |
| 4,894,265 | 1/1990 | Chang et al. | 428/34.6 |
| 4,921,746 | 5/1990 | Patriksson | 428/178 |
| 5,084,324 | 1/1992 | Schirmer | 428/139 |
| 5,088,686 | 2/1992 | Soofi | 249/112 |
| 5,102,036 | 4/1992 | Orr et al. | 220/903 X |
| 5,271,980 | 12/1993 | Bell | 428/68 |
| 5,282,686 | 2/1994 | Haber | 383/10 |
| 5,340,632 | 8/1994 | Chappuis | 428/71 |

FOREIGN PATENT DOCUMENTS

| | | | |
|---|---|---|---|
| 903153 | 12/1985 | Belgium . | |
| 85534 | 8/1983 | European Pat. Off. | 383/110 |
| 174159 | 3/1986 | European Pat. Off. . | |
| 301148 | 2/1989 | European Pat. Off. . | |
| 89099 | 5/1967 | France | 229/89 |
| 2309419 | 11/1976 | France | 383/10 |
| 2415943 | 9/1979 | France | 383/10 |
| 9002034 | 6/1990 | Germany . | |
| 4227659 | 2/1994 | Germany . | |
| 24666 | 1/1990 | Japan | 206/147 |
| 455944 | 10/1936 | United Kingdom | 383/10 |
| 2174361 | 11/1986 | United Kingdom | 383/10 |

*Primary Examiner*—Sue A. Weaver

*Attorney, Agent, or Firm*—Panitch Schwarze Jacobs & Nadel, P.C.

[57] ABSTRACT

The disclosure of the present invention describes a thermally insulated container formed of multiwall flexible plastic heat sealed to define a multiplicity of sealed air bubbles and being formed with a radiation reflective coating. The container includes an integrally formed carrying handle.

4 Claims, 11 Drawing Sheets

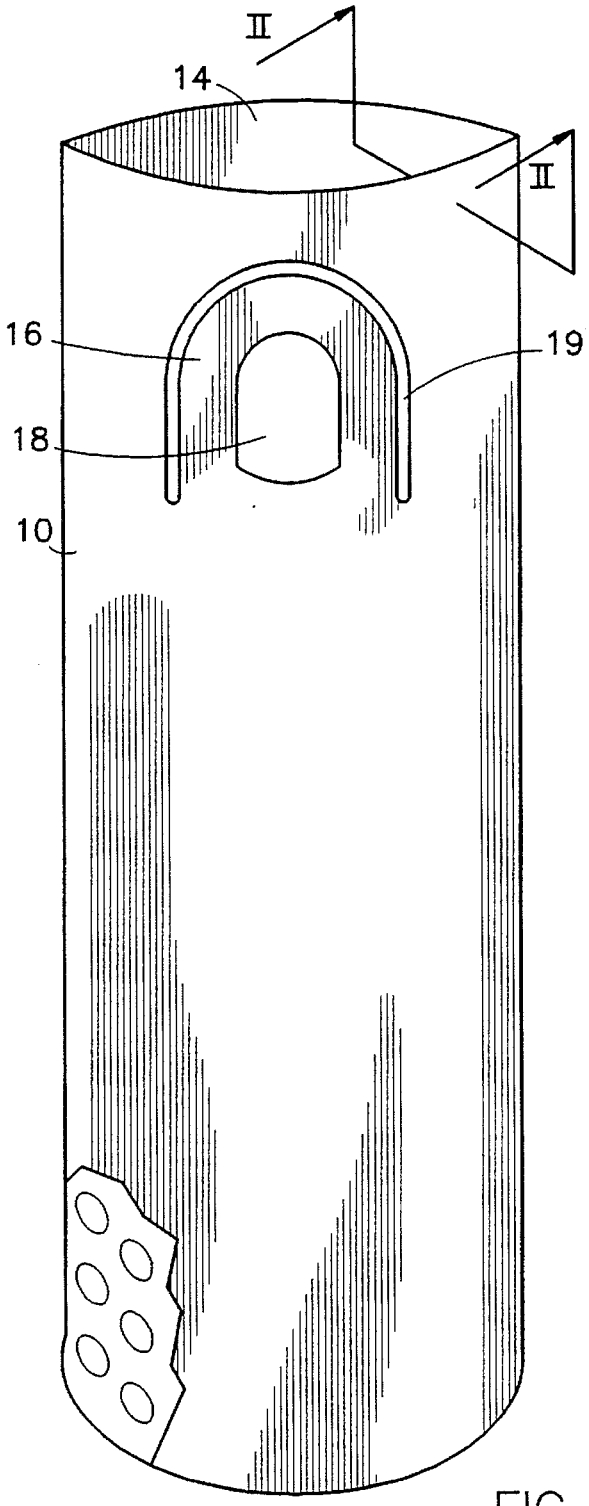
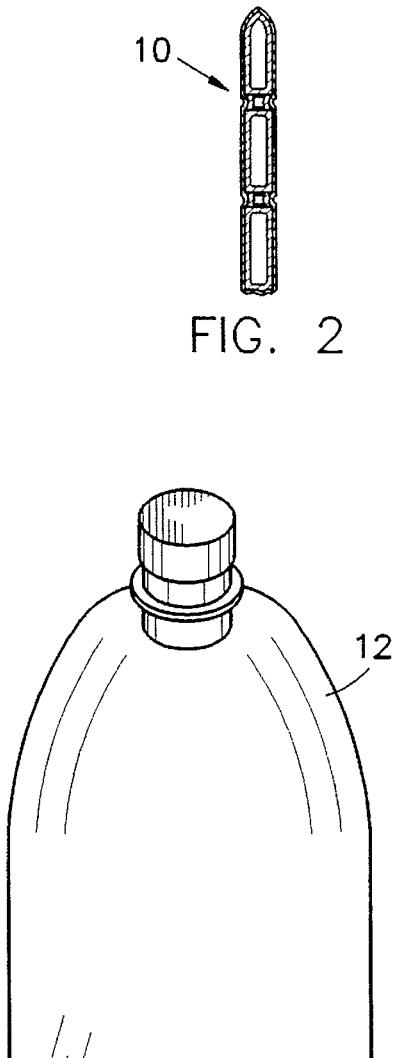
FIG. 2
FIG. 1

INSULATED CARRYING CONTAINER

FIELD OF THE INVENTION

The present invention relates generally to containers and more particularly to insulated carrying containers for beverages and the like.

BACKGROUND OF THE INVENTION

Various types of insulated containers are known. U.S. Pat. Nos. 1,939,677 and 4,197,890 describe examples of known insulated containers.

Bubble packaging is also known in the art, normally for preventing impact damage to goods wrapped therein. The following U.S. patents describe various structures of bubble packaging and certain applications thereof: U.S. Pat. Nos. 5,088,686; 4,894,265; 5,271,980; 5,340,632; 5,084,324; 4,825,089; 4,921,746 and 4,868,025.

SUMMARY OF THE INVENTION

The present invention seeks to provide an improved, relatively low cost insulated container.

There is thus provided in accordance with a preferred embodiment of the present invention a thermally insulated container formed of multiwall flexible plastic heat sealed to define a multiplicity of sealed air bubbles.

In accordance with a preferred embodiment of the present invention, the container includes an integrally formed carrying handle.

Further in accordance with a preferred embodiment of the present invention, the container has printed on at least one of the walls thereof an advertising message.

Additionally in accordance with a preferred embodiment of the present invention, the container is formed with a radiation reflective coating.

In accordance with a preferred embodiment of the invention, the container has an overall tube shape and is configured to generally tightly surround a bottle.

In accordance with one preferred embodiment of the invention, the container has integrally formed therewith at least one bottle opening engagement flap for retaining the cover in surrounding relationship with the bottle.

BRIEF DESCRIPTION OF THE DRAWINGS

The present invention will be understood and appreciated more fully from the following detailed description, taken in conjunction with the drawings in which:

FIG. 1 is a simplified illustration of a bottle and an insulated container therefor, constructed and operative in accordance with a preferred embodiment of the present invention;

FIG. 2 is a sectional illustration of part of the container shown in FIG. 1, along line II—II of FIG. 1;

FIG. 15B is in the direction of arrow 15B of FIG. 15A; FIG. 15B is in the direction of arrow 16B of FIG. 16A.

DETAILED DESCRIPTION OF PREFERRED EMBODIMENTS

Figure 3:
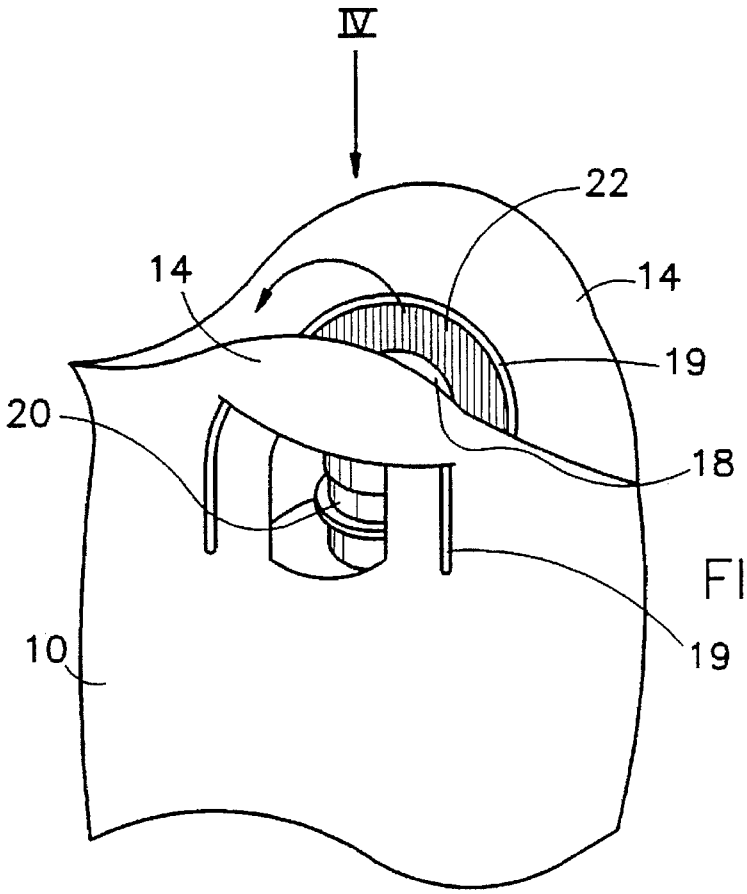
FIG. 3 is a pictorial illustration of a first step in closing the container over the bottle of FIG. 1.

Reference is now made to FIGS. 1–7, which illustrate a thermally insulative container 10 which is configured in a generally tubular configuration so as to accommodate a bottle 12, such as a conventional 1.5 liter soft drink bottle.

Referring specifically to FIG. 2, it is seen that most or all of container 10 is formed of a multi-ply sealed-bubble flexible plastic material, which is conventionally available from various vendors in the U.S.A. and elsewhere. The multi-ply sealed-bubble material typically comprises at least three plies of plastic which are sealed together in such a manner as to trap air bubbles at a multiplicity of predetermined locations therein.

In accordance with a preferred embodiment of the present invention, the container 10 bears printed advertising material on at least one ply thereof, which need not necessarily be the outer ply thereof.

Further in accordance with a preferred embodiment of the present invention, the container is formed on the outer surface thereof with a radiation reflective surface, such as a silvered or white surface, which may be coated over one of the plies of the sealed-bubble material or alternatively added as an additional ply and sealed thereto.

It is seen that the container defines a two-ply carrying handle portion 14 and a pair of attachment flaps 16, each of which has a central aperture 18 and which is separated from the handle portion 14 by a cut 19.

Figure 4:
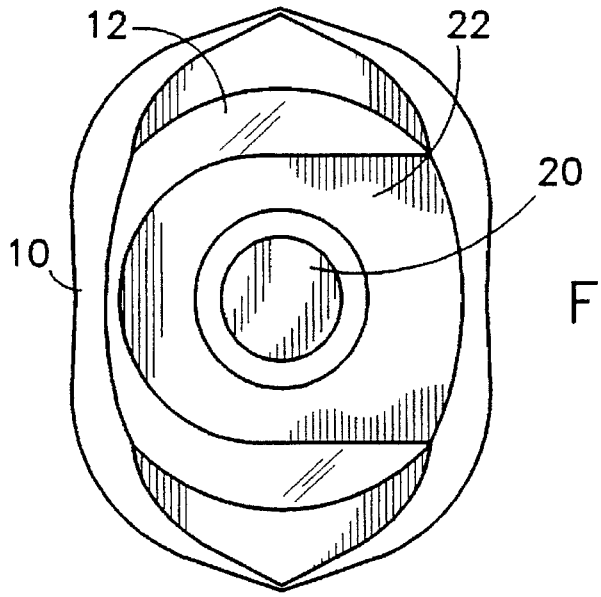
FIG. 4 is a top view illustration of the container after completion of the first step.
Figure 5:
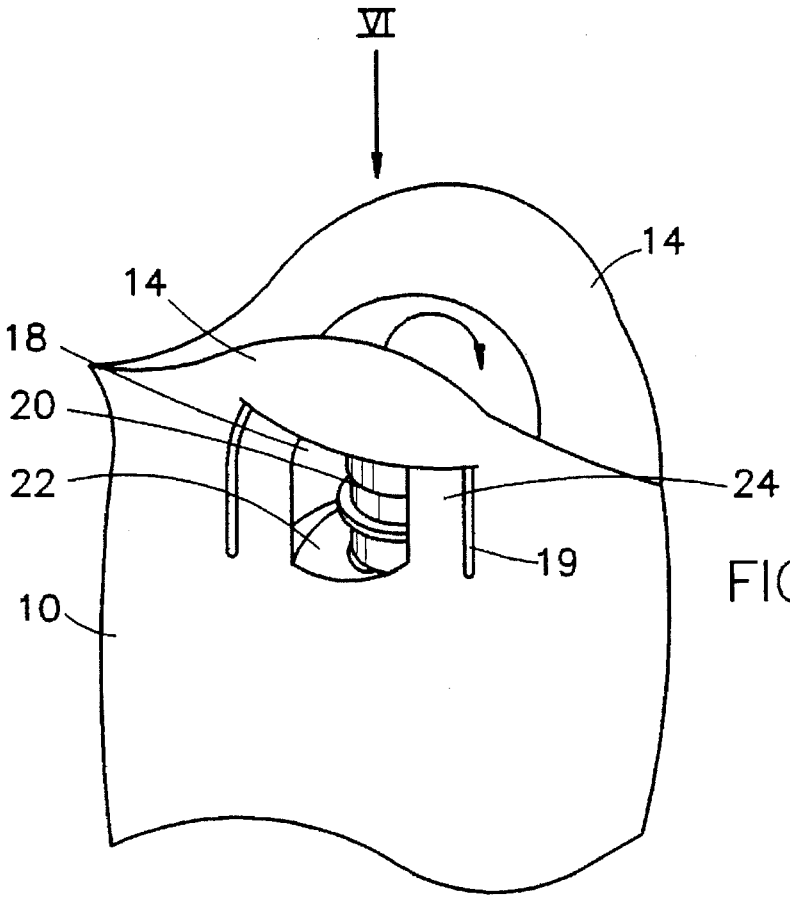
FIG. 5 is a pictorial illustration of a final step in closing the container over the bottle of FIG. 1.
Figure 6:
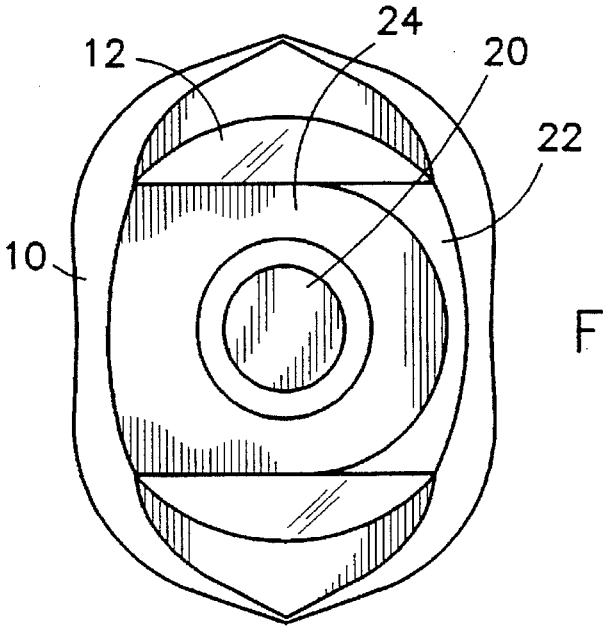
FIG. 6 is a top view illustration of the container after completion of the final step.

In accordance with a preferred embodiment of the present invention, the attachment flaps 16 are sequentially folded over the mouth 20 of the bottle 12, so as to secure the container tightly over the bottle, for maximum thermal insulation efficiency. FIG. 3 shows folding of a first flap, here indicated by reference numeral 22, over the mouth 20 of the bottle, such that the mouth extends through aperture 18, as seen in FIG. 4. FIG. 5 shows folding of a second flap, here indicated by reference numeral 24, over the first flap 22 and over the mouth 20 of the bottle, such that the mouth extends through aperture 18, as seen in FIG. 6.

Figure 7:
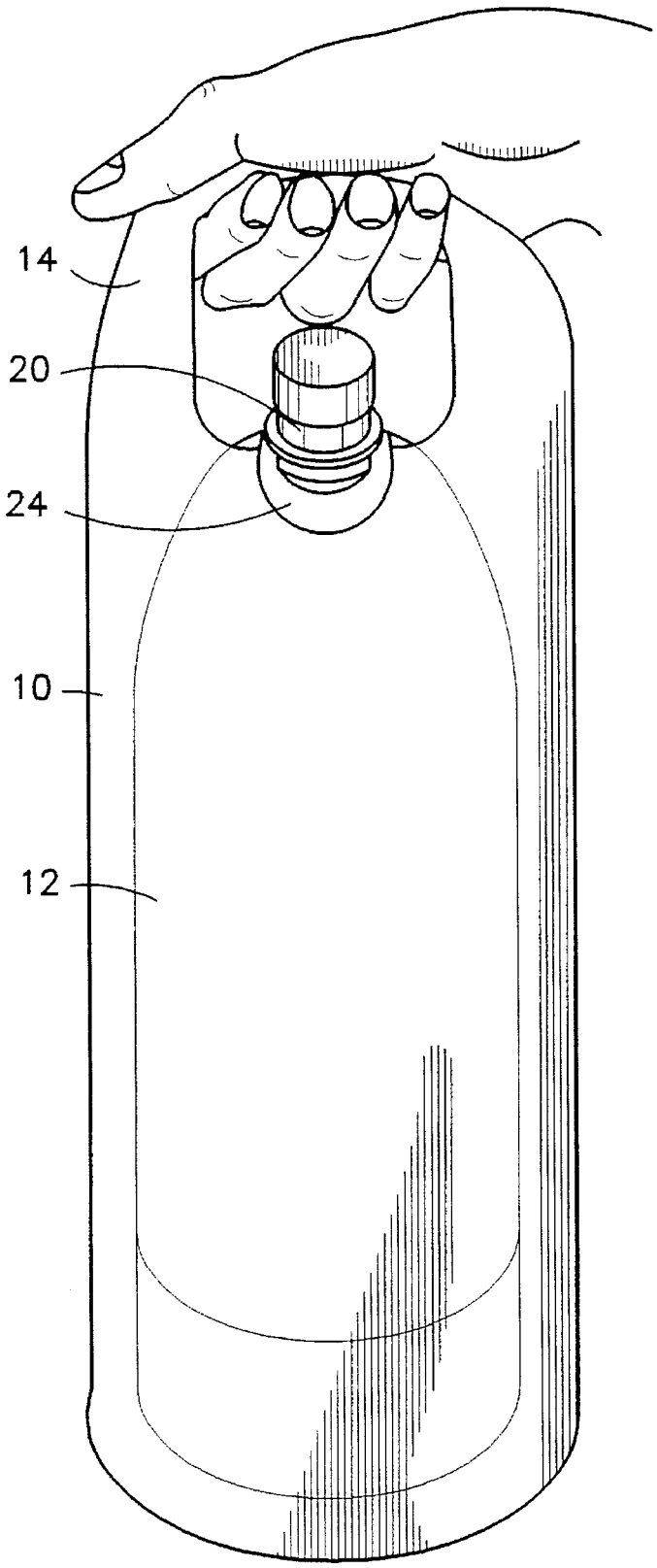
FIG. 7 is a pictorial illustration of the container of FIGS. 1–6, fully closed over a bottle and held by a user.
Figure 8:
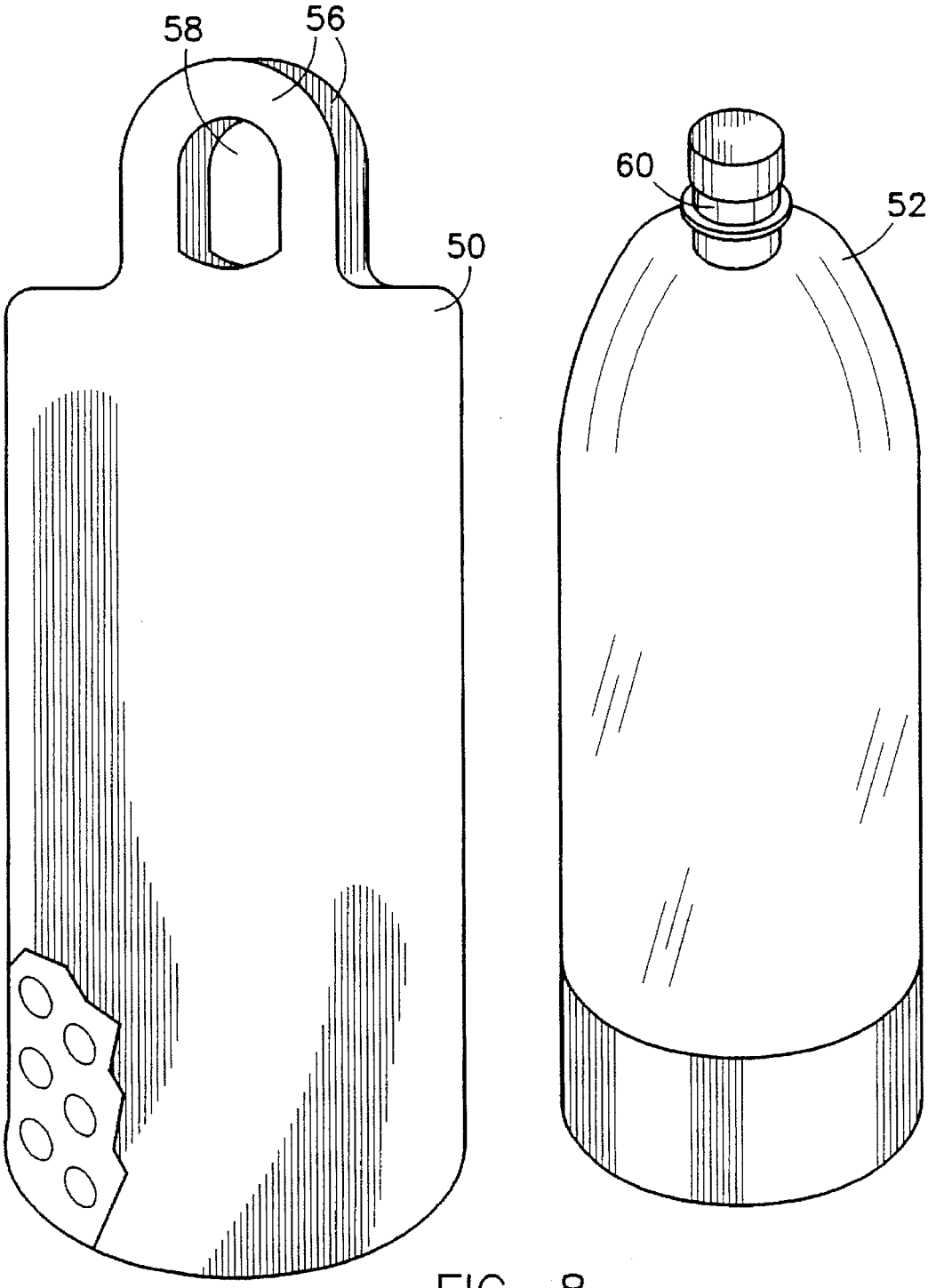
FIG. 8 is a simplified illustration of a bottle and an insulated container therefor, constructed and operative in accordance with another preferred embodiment of the present invention.

FIG. 7 illustrates a pictorial illustration of the container of FIGS. 1–6, fully closed over a bottle and held by a user.

Reference is now made to FIG. 8–13, which illustrate a thermally insulative container 50, constructed and operative in accordance with an alternative embodiment of the present invention, which is configured in a generally tubular configuration so as to accommodate a bottle 52, such as a conventional 1.5 liter soft drink bottle.

The structure of the container may be identical with that described hereinabove with reference to FIG. 2. Similar to the container of FIGS. 1–7, the container may bear advertising material and may have an outer reflective surface.

It is seen that the container defines a pair of attachment flaps 56, each of which has a central aperture 58.

Figure 9:
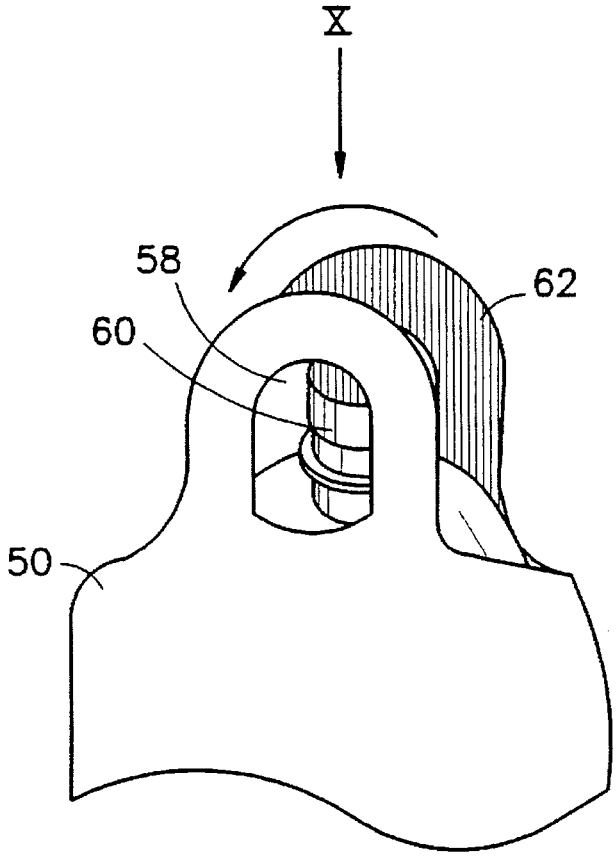
FIG. 9 is a pictorial illustration of a first step in closing the container over the bottle of FIG. 8.
Figure 10:
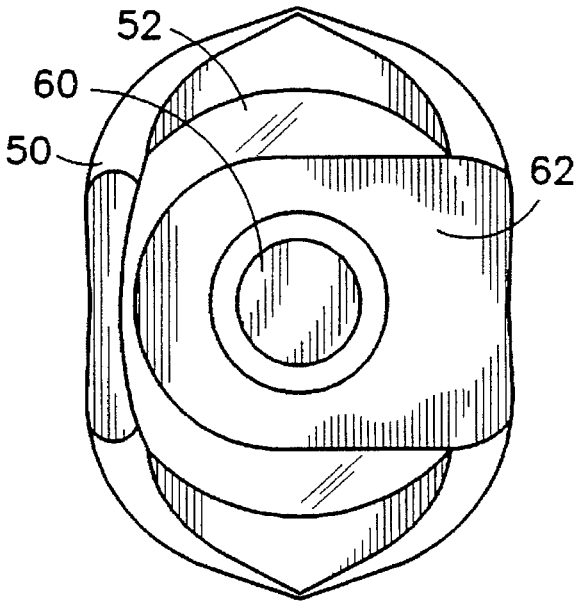
FIG. 10 is a top view illustration of the container of FIG. 8, in direction of the arrow X of FIG. 9, following completion of the first step.
Figure 11:
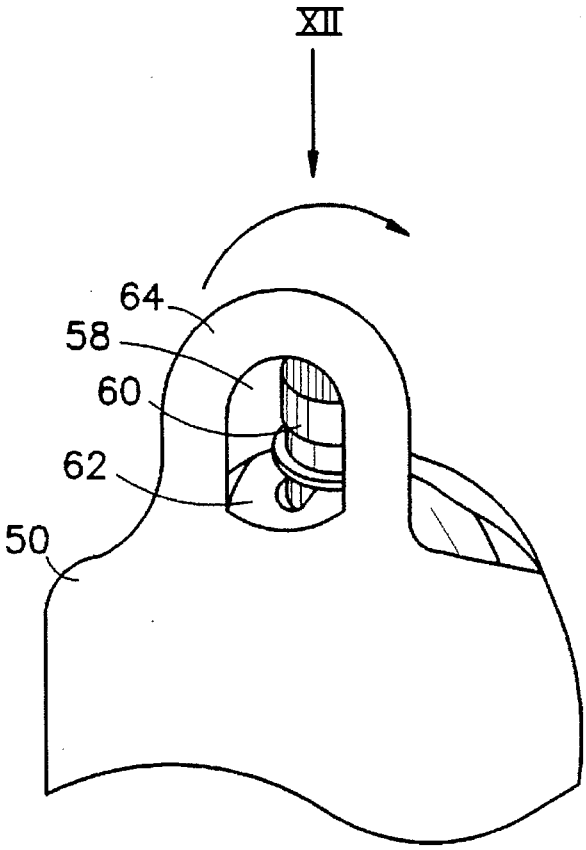
FIG. 11 is a pictorial illustration of a final step in closing the container over the bottle of FIG. 8.
Figure 12:
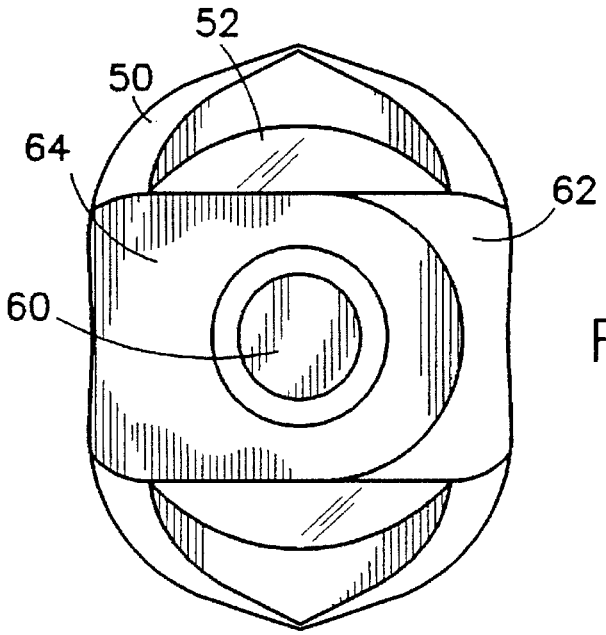
FIG. 12 is a top view illustration of the container, in direction of arrow XII of FIG. 11, after completion of the final step.

In accordance with a preferred embodiment of the present invention, the attachment flaps 56 are sequentially folded over the mouth 60 of the bottle 52, so as to secure the container tightly over the bottle, for maximum thermal insulation efficiency. FIG. 9 shows folding of a first flap, here indicated by reference numeral 62, over the mouth 60 of the bottle, such that the mouth extends through aperture 58, as seen in FIG. 10. FIG. 11 shows folding of a second flap, here indicated by reference numeral 64, over the first flap 62 and over the mouth 60 of the bottle, such that the mouth extends through aperture 58, as seen in FIG. 12.

Figure 13:
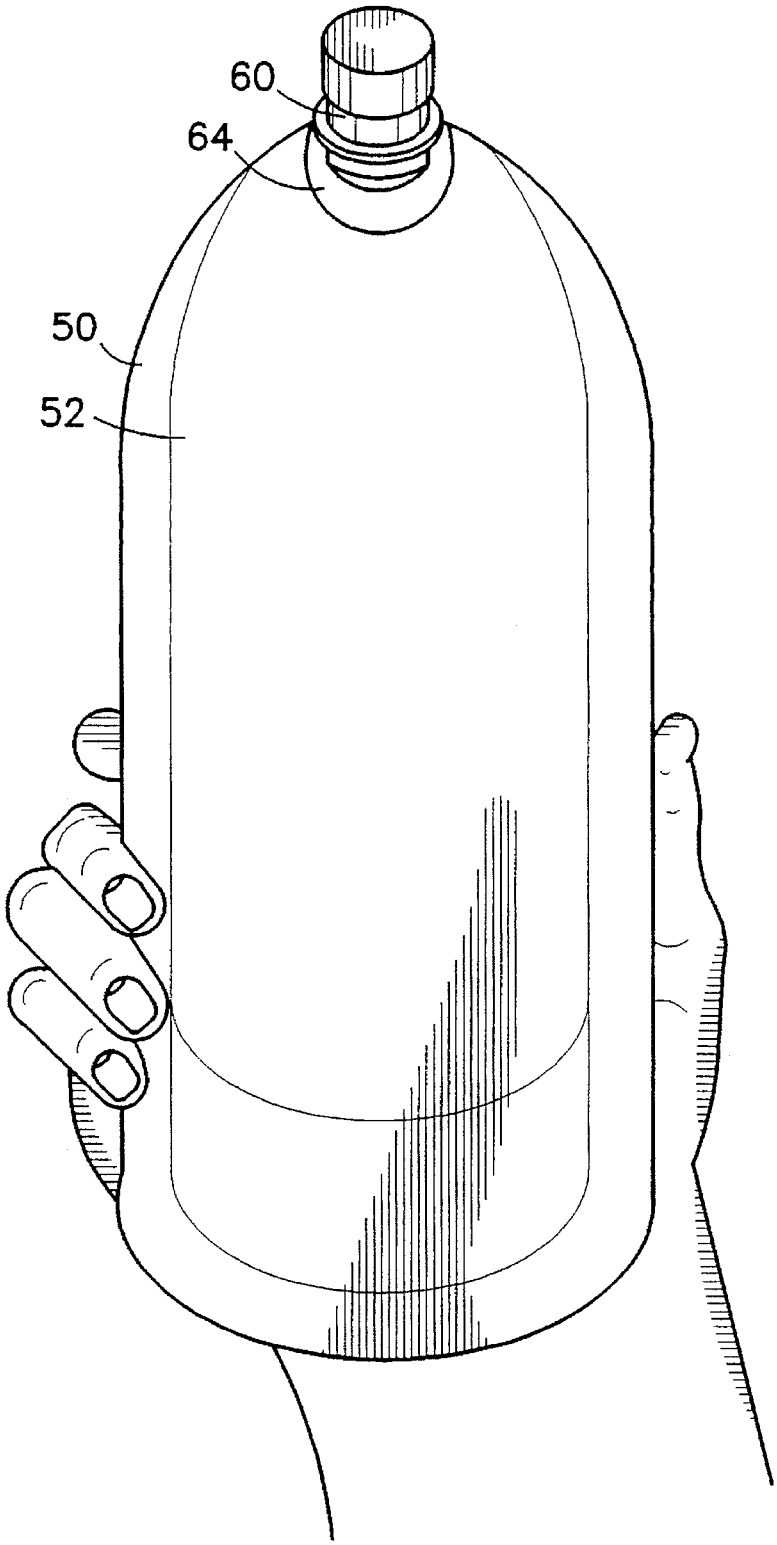
FIG. 13 is a pictorial illustration of the container of FIGS. 8–12, fully closed over a bottle and held by a user.

FIG. 13 illustrates a pictorial illustration of the container of FIGS. 8–12, fully closed over a bottle and held by a user.

Figure 14:
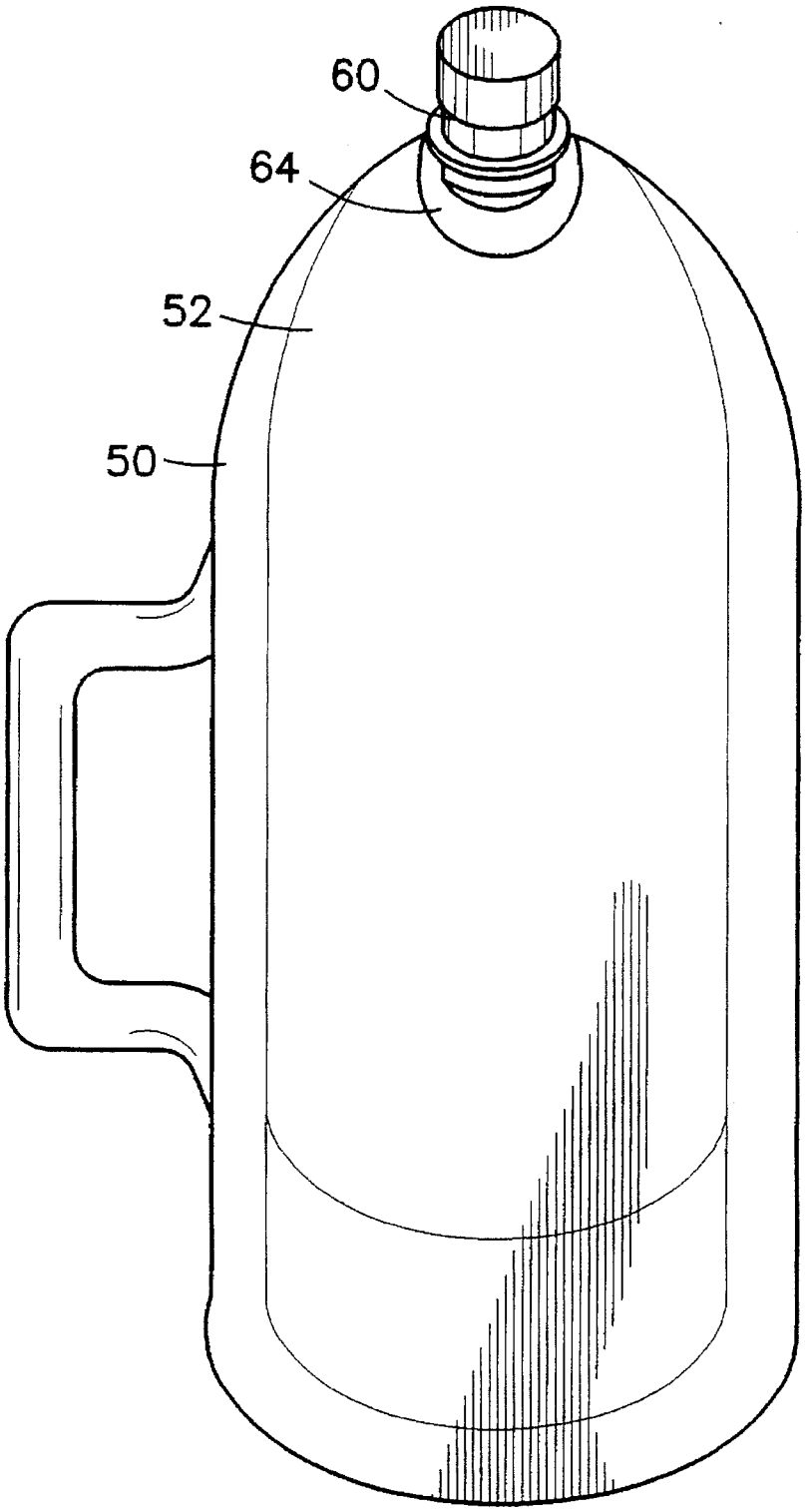
FIG. 14 is a simplified pictorial illustration of a container and a bottle, the container being constructed and operative in accordance with another preferred embodiment of the present invention.
Figure 15A:
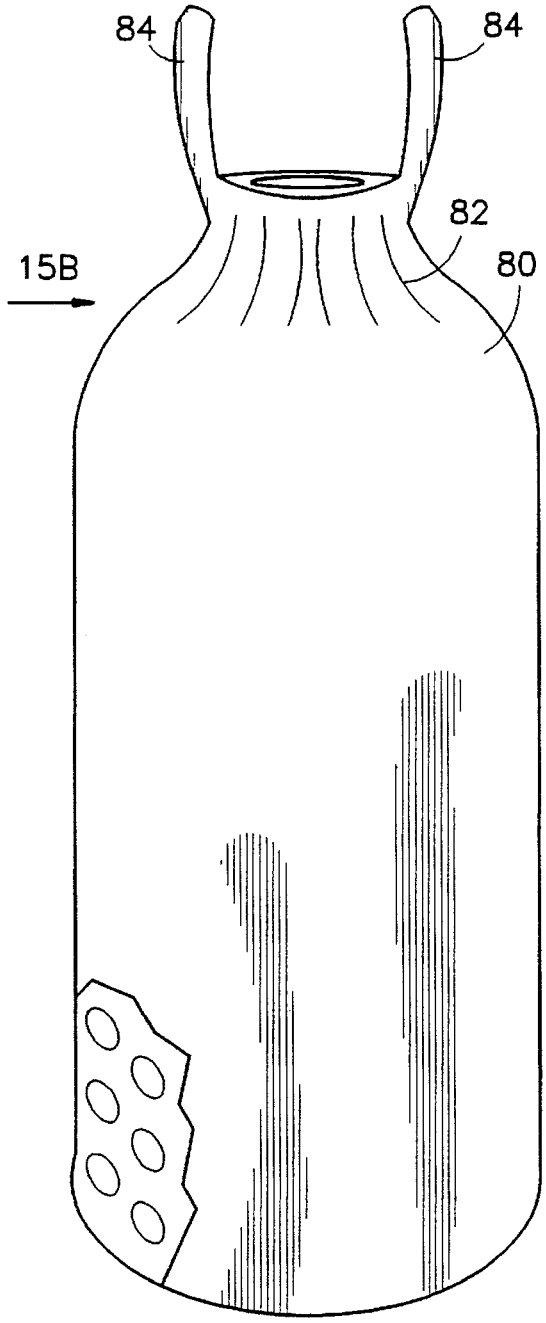
FIGS. 15A and 15B are two side view illustrations of a container constructed and operative in accordance with a further alternative embodiment of the invention, where
Figure 15B:
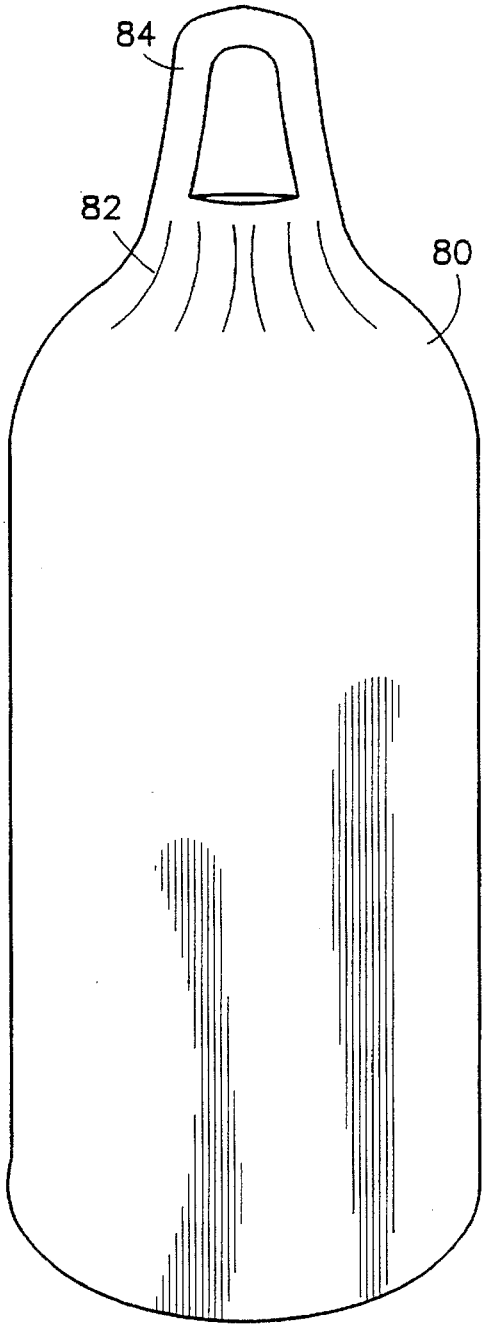
Figure 16A:
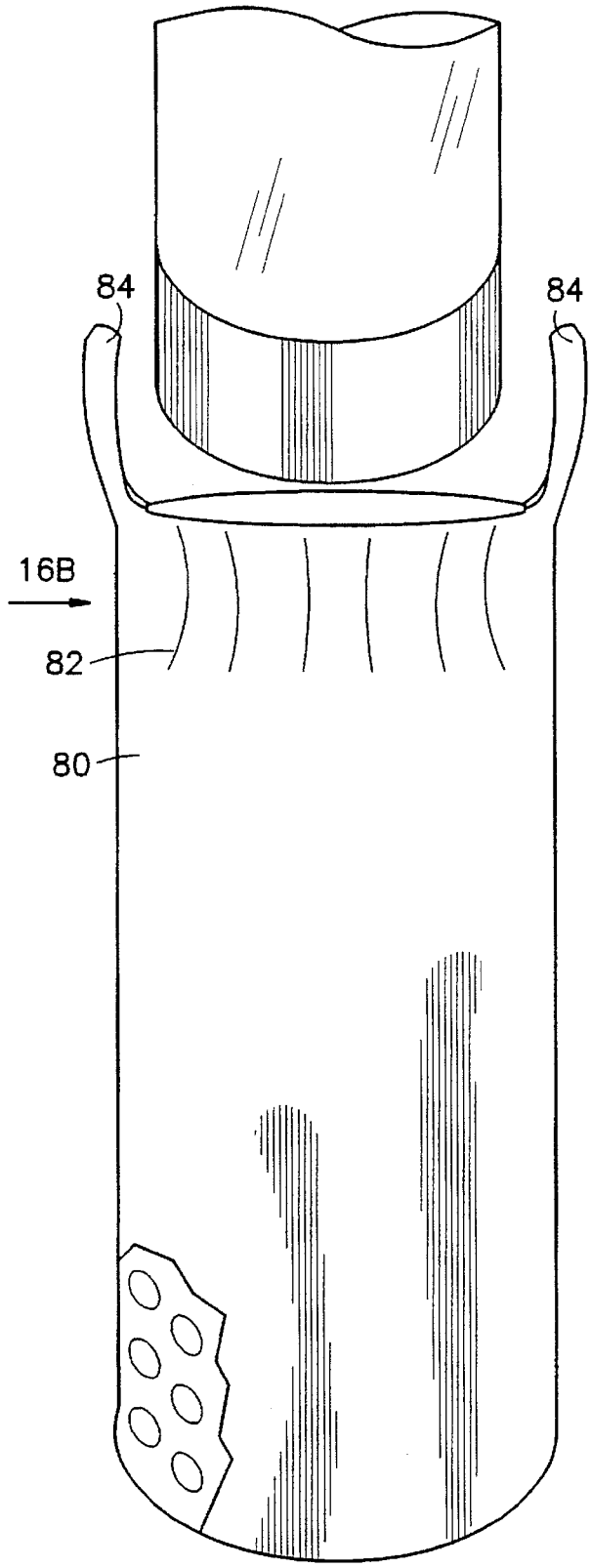
FIGS. 16A and 16B are two side view illustrations of the container of FIGS. 15A and 15B respectively upon insertion of a bottle thereinto and following insertion, where
Figure 16B:
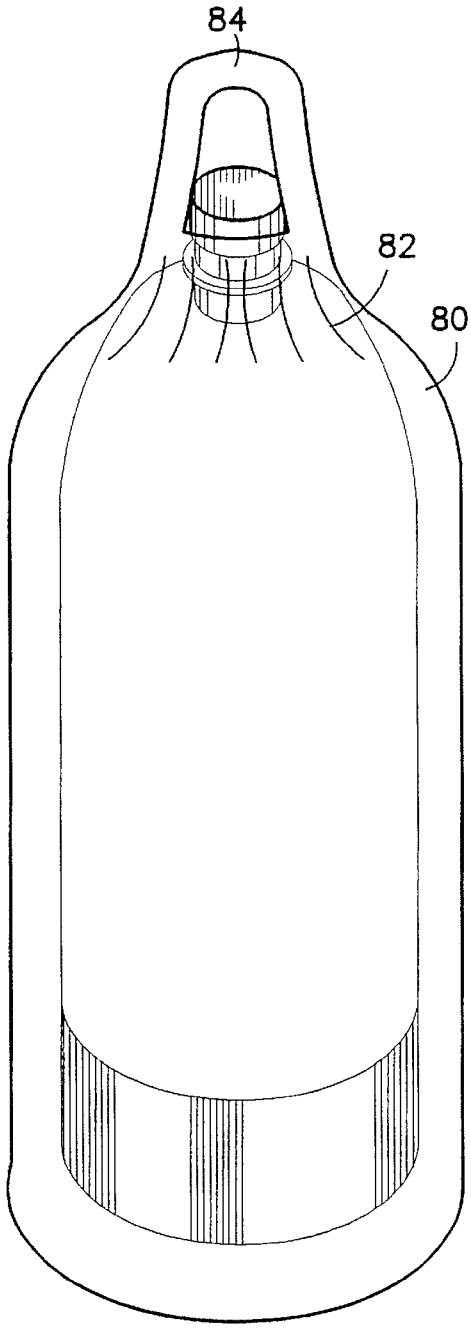

Reference is now made to FIG. 14, which is a simplified pictorial illustration of a container and a bottle, the container being constructed and operative in accordance with yet another preferred embodiment of the present invention. Here the handle is formed on the side of the bottle, but the closing the container over the bottle employing flaps, may be identical to that in the embodiment of FIGS. 8–13.

Reference is now made to FIGS. 15A–16B, which illustrate a container 80 constructed and operative in accordance with a further alternative embodiment of the invention. Here the container 80 is formed with an resilient elastic neck portion 82, which normally does not include sealed bubbles, but serves to retain the container on the bottle. The container is formed with a pair of carrying handles 84.

It will be appreciated by persons skilled in the art that the present invention is not limited by what has been particularly shown and described hereinabove. Rather the scope of the present invention is defined only by the claims which follow:

We claim:

1. A thermally insulated container for a bottle, said container being formed of multiwall flexible plastic heat sealed to define a multiplicity of air bubbles, said container defining a pair of carrying handles and a pair of attachment flaps for retaining said container in engagement with said bottle, each of said attachment flaps having a central aperture, each of said flaps being separated from a corresponding handle by a cut.

2. A container according to claim 1 and wherein said container being formed with a radiation reflective coating.

3. A container according to claim 1 having an overall tube shape being configured to generally tightly surround a bottle.

4. A container according to claim 1 and wherein said pair of attachment flaps are arranged to be folded one over the other in engagement with the mouth of a bottle.

* * * * *